US006499166B1

(12) United States Patent
Jones

(10) Patent No.: US 6,499,166 B1
(45) Date of Patent: Dec. 31, 2002

(54) APPARATUS FOR ELEVATION OF HEAD AND TORSO IN FLUIDIZED PATIENT SUPPORT

(75) Inventor: Mark Jones, San Antonio, TX (US)

(73) Assignee: KCI Licensing, San Antonio, TX (US)

( * ) Notice: Subject to any disclaimer, the term of this patent is extended or adjusted under 35 U.S.C. 154(b) by 0 days.

(21) Appl. No.: 09/398,670

(22) Filed: Sep. 17, 1999

Related U.S. Application Data

(63) Continuation of application No. PCT/US98/05247, filed on Mar. 17, 1998.
(60) Provisional application No. 60/040,944, filed on Mar. 17, 1997.

(51) Int. Cl.[7] ..... A61G 7/057
(52) U.S. Cl. ..... 5/689; 5/615; 5/715; 5/912
(58) Field of Search ..... 5/612, 614, 615, 5/702, 710, 713, 714, 715, 733, 734, 912, 689

(56) References Cited

U.S. PATENT DOCUMENTS

| | | | |
|---|---|---|---|
| 3,978,530 A | 9/1976 | Amarantos | 5/68 |
| 4,525,885 A | 7/1985 | Hunt et al. | 5/453 |
| 4,685,163 A | 8/1987 | Quillen et al. | 5/455 |
| 4,941,221 A | 7/1990 | Kanzler | 5/60 |
| 5,105,487 A | 4/1992 | Hakamiun et al. | 5/614 |
| 5,497,520 A | 3/1996 | Kunz et al. | 5/648 |

OTHER PUBLICATIONS

PCT International Search Report; PCT International application PCT/US98/05247; Aug. 20, 1998.
PCT Written Opinion; PCT International application PCT/US98/05247; Feb. 8, 1999.
PCT International Preliminary Examination Report; PCT International application PCT/US98/05247; Jun. 24, 1999.

*Primary Examiner*—Michael F. Trettel

(57) ABSTRACT

An apparatus for elevating the head and torso of a patient confined to a fluidized patient support system. A head cushion assembly, a knee gatch assembly and a control assembly are integrated with any known fluidized patient support system and preferably integrated, at least in part, with the cover sheet of the chosen patient support system. In operation, the invention may be utilized to raise and/or lower a patient's head and torso, in 15° steps, to any inclination from supine to approximately 45°. In implementations utilizing the knee gatch assembly, the patient is effectively prevented from sliding during inclination even to the highest of angles. The controls are conveniently provided on a handheld unit for easy access and operation by caregivers and patient alike.

10 Claims, 9 Drawing Sheets

APPARATUS FOR ELEVATION OF HEAD AND TORSO IN FLUIDIZED PATIENT SUPPORT

RELATED APPLICATION

This application is a continuation of PCT international application No. PCT/US98/05247 filed Mar. 17, 1998, which claims priority to U.S. provisional patent application Ser. No. 60/040,944 filed Mar. 17, 1997. By this reference, the full disclosures, including the drawings, of PCT international application No. PCT/US98/05247 and U.S. provisional patent application Serial No. 60/040,944 are incorporated herein as though each were now set forth in their respective entirety.

FIELD OF THE INVENTION

The present invention relates to fluidized patient support systems. More specifically, the present invention relates to an apparatus for providing up to 45° to the head and torso of a patient confined to a fluidized hospital bed, while preventing sliding of the patient and without complete loss of the therapeutic benefit provided by the bed system.

BACKGROUND OF THE INVENTION

Fluidized patient support systems are generally recognized by those of ordinary skill in the art as providing the most ideal support surface available for reduction of bed to patient interface pressures. As is well known in the art, these systems generally comprise a relatively rigid tank containing a large mass of fluidizable media, such as tiny polyurethane coated glass beads, retained under the cover of at least one but preferably two air-permeable sheets. A provided blower assembly is utilized to "fluidize" the operable media, usually by forcing a volume of air from the bottom of the tank and through the media. Exemplary fluidized patient support systems include the trade name "ELITE" series commercially available from Kinetic Concepts, Inc. of San Antonio, Tex. under the trademark "FLUIDAIR" and the trademark "CLINITRON" series commercially available from Hill-Rom of Charleston, S.C.

Unfortunately, the near-ideal interface surface provided by fluidized patient support systems is not conducive to providing the patient with other facilities for increased comfort, such as a head and torso elevation function. Due to the minimized friction concomitant the reduced interface pressure, the patient has a dramatic tendency to slide toward the foot of the bed at any time force is applied in a longitudinal direction. Consequently, raising the head and torso of the patient will generally result in cramping of the patient's feet against the foot of the bed, which is uncomfortable and in extreme cases may even result in pressure sores and the like. It is therefore a specific object of the present invention to provide an apparatus for use in a fluidized patient support system whereby the patient is automatically prevented from sliding while raising the patient's head and torso.

While the head and torso of patient's in fluidized patient support systems have previously been raised by inserting foam cushions and the like beneath the patient, this method is considered undesirable. Much of the therapeutic benefit provided by fluidized patient support systems derives from the flow of air adjacent the patient's skin. It is therefore a specific object of the present invention to provide an apparatus for use in a fluidized patient support system whereby the patient's head and torso may be raised without complete loss of the therapeutic benefit available in the head and torso areas.

SUMMARY OF THE INVENTION

In accordance with the foregoing objects, the present invention generally comprises a an apparatus for elevating the head and torso of a patient using a fluidizable patient support system includind an inflatable upper body lift at the head end of the patient support system for elevating the head and torso of a patient using the patient support system. The inflatable upper body lift may comprise a plurality of inflatable chambers which may be stacked one atop another. In at least one embodiment, the inflatable chambers are removably attached one to another and in at least one other embodiment the inflatable chambers comprise a low air loss material. The entire inflatable upper body lift may removably attached to the fluidizable patient support system.

In a further embodiment of the present invention, a lower body lift is provided between the upper body lift and the leg end of the fluidizable patient support system. The lower body lift, which may comprise a removably attached inflatable chamber, is adapted to automatically prevent sliding of the patient during elevation of the patient's head and torso.

In yet a further embodiment of the present invention, the lower body lift and at least one upper body lift inflatable chamber are in fluid communication with a common source of pressurized fluid. This common source may be automatically regulated to maintain a selected patient support surface firmness.

Many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
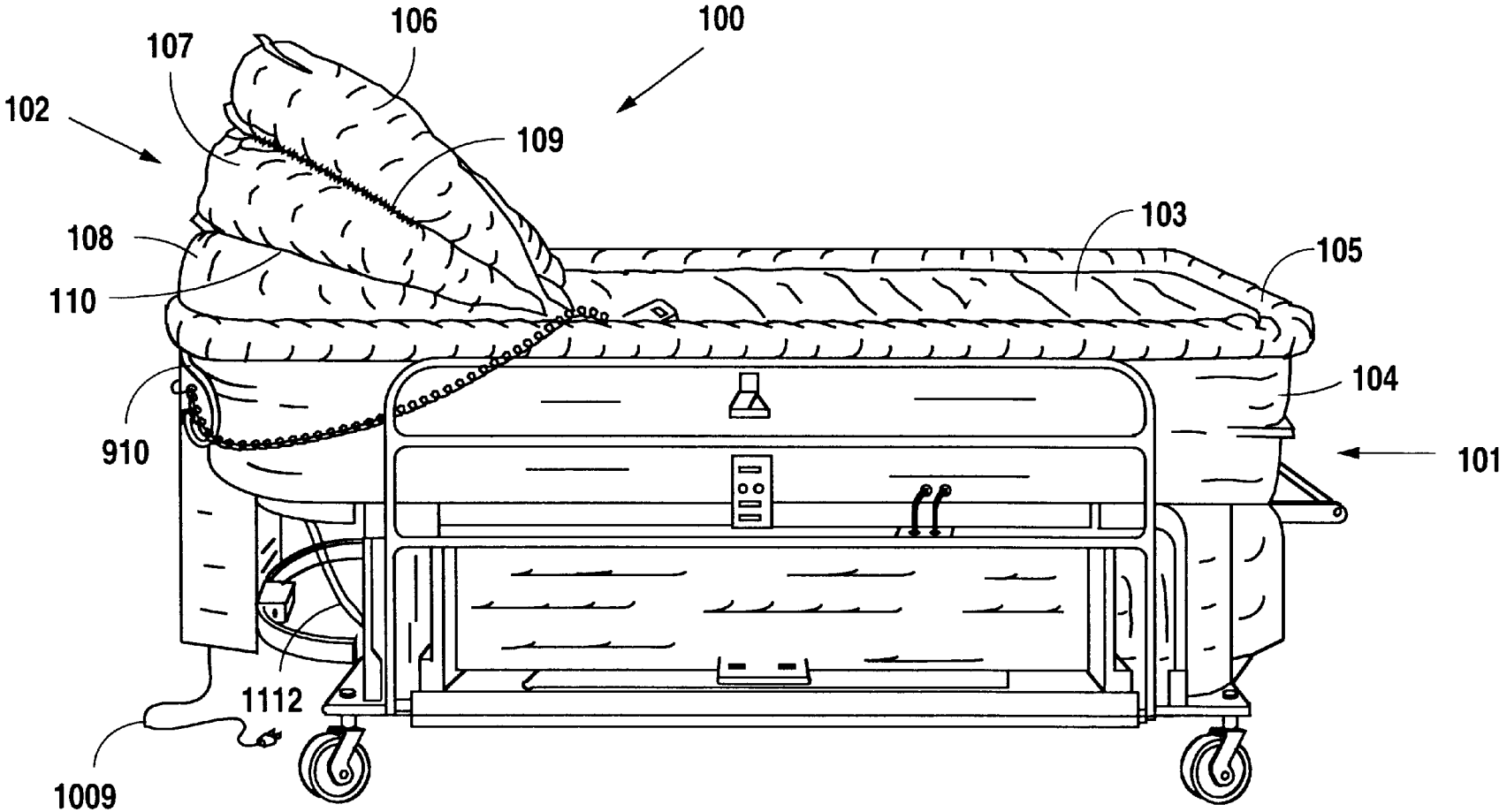
FIG. 1 shows a side elevation of the present invention with the head cushion assembly in its most elevated state.

Although those of ordinary skill in the art will readily recognize many alternative embodiments, especially in light of the illustrations provided herein, this detailed description is exemplary of the preferred embodiment of the present invention—an apparatus 100 for elevation of the head and torso of a person confined to a fluidized patient support system 101, the scope of which is limited only by the claims appended hereto. The present invention generally comprises a head cushion assembly 102, a knee gatch assembly 901 and a control assembly 1101, integrated with any known fluidized patient support system 101 and preferably integrated, at least in part, with the cover sheet 103 of the chosen patient support system. In operation, the present invention may be utilized to raise and/or lower a patient's head and torso, in 15° steps, to any inclination from supine to approximately 45°. In implementations utilizing the knee gatch assembly 901, the patient is effectively prevented from sliding during inclination even to the highest of angles. Finally, the controls for the present invention are conveniently provided on a handheld unit 1201 for easy access and operation by caregivers and the patient alike.

As will be better understood further herein, the present invention may be implemented as part of the original design for a fluidized patient support system 101 or as an after market modification to any of the presently existing systems. As is well known to those of ordinary skill in the art, a fluidized patient support system 101 generally comprises a relatively rigid tank 104 containing a large mass of fluidizable media, such as tiny polyurethane coated glass beads, retained under the cover of at least one but preferably two air-permeable sheets 902. A provided blower assembly 1102 is utilized to "fluidize" the operable media, usually by forcing a volume of air 1103 from the bottom of the tank 104 and through the media. The resultant patient support surface is generally recognized by those of ordinary skill in the art as the most ideal available for reduction of bed to patient interface pressures. Exemplary fluidized patient support systems, with which the present invention may readily be implemented, include the trade name "ELITE" series commercially available from Kinetic Concepts, Inc. of San Antonio, Tex. under the trademark "FLUIDAIR" and the trademark "CLINITRON" series commercially available from Hill-Rom of Charleston, SC.

Figure 2:
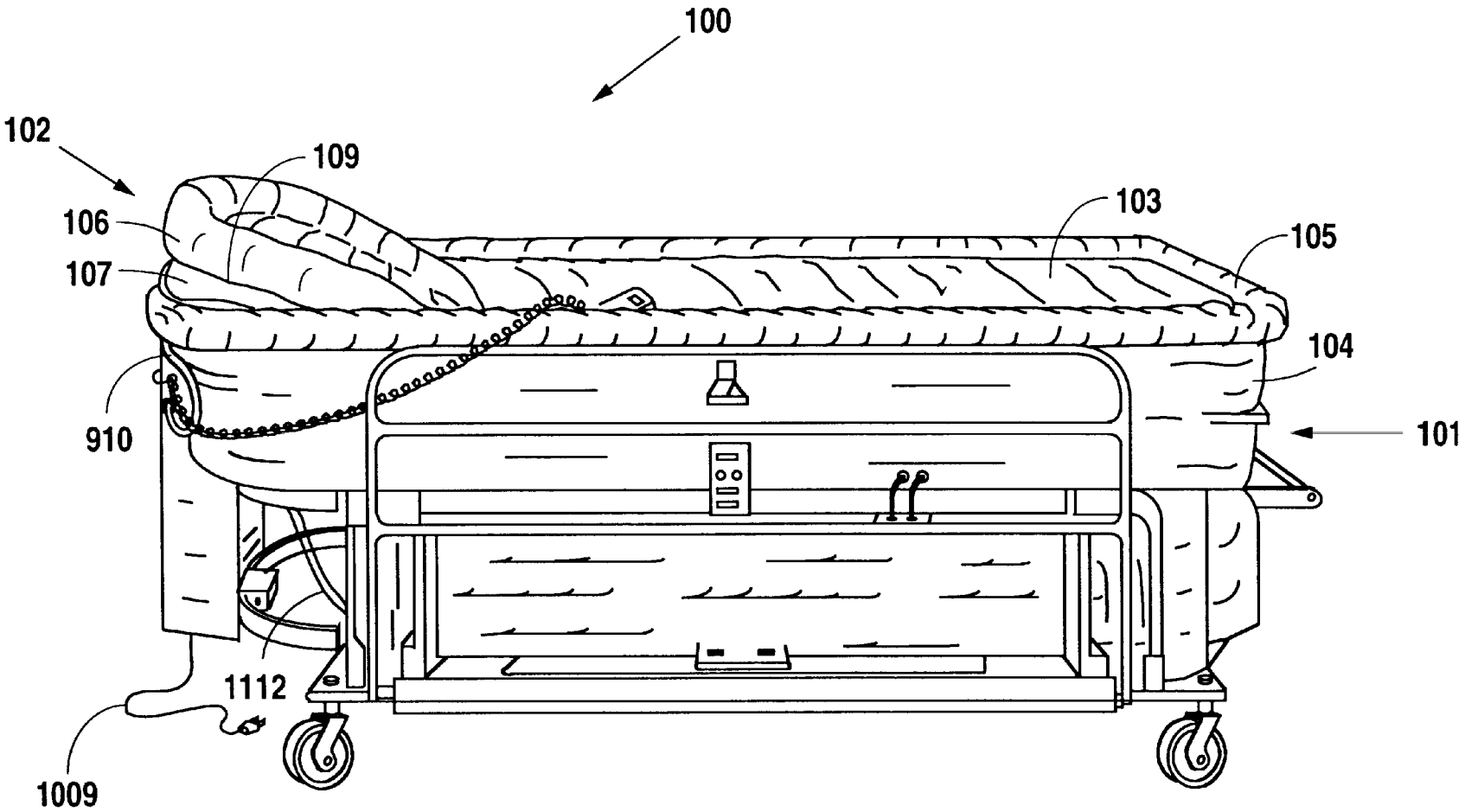
FIG. 2 shows a side elevation of the present invention, as depicted in FIG. 1, with the head cushion assembly in a low elevation.

As particularly depicted in FIGS. 1 and 2, the preferred embodiment of the present invention generally comprises positioning a head cushion assembly 102 atop the cover sheet 103 over the head end of a fluidized patient support system 101. As will be better understood further herein, the head cushion assembly 102 is removably attached, preferably with a zipper mechanism 903, to the cover sheet 103 which, in the typical configuration, is secured to the periphery of the support system's rigid tank 104 by a flexible extrusion 105. According to the preferred embodiment of the present invention, the head cushion assembly 102 comprises a plurality of individually inflatable cushions 106, 107, 108, stacked one atop another and attached with zipper mechanisms 109, 110. Although those of ordinary skill in the art will recognize that the present invention may be equivalently implemented with other numbers, the preferred embodiment of the present invention comprises three cushions—a top cushion 106, a middle cushion 107 and a bottom cushion 108, each described in detail further herein.

In operation, as will be better understood further herein, each cushion 106, 107, 108 provides 15° inclination of the patient's head and torso. As a result, the elevation apparatus 100 of the present invention enables inclination of the patient's head and torso from supine to approximately 45°, as depicted in FIG. 1, in 15° increments therebetween, such as the relatively low 15° inclination depicted in FIG. 2. While many alternative implementations of the present invention are possible, as will be recognized by those of ordinary skill in the art, it is considered critical to the present invention that the head cushion assembly 102 is fully deflatable, regardless of its specific implementation. By making the head cushion assembly 102 fully deflatable, the present invention allows the patient to assume a fully supine position, quite possibly even enabling the patient to receive the therapeutic benefit of the fluidized surface, without necessity for removal of preformed cushions.

Figure 3:
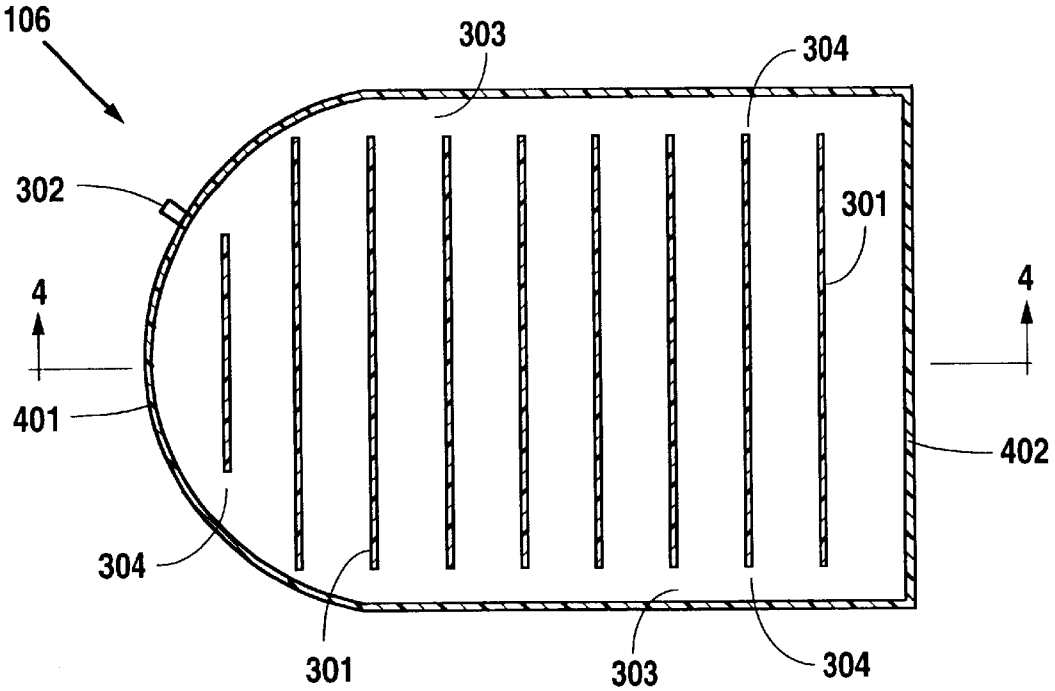
FIG. 3 shows a horizontal cross sectional view of the top cushion of the head cushion assembly taken along line 3—3 in FIG. 4.
Figure 4:
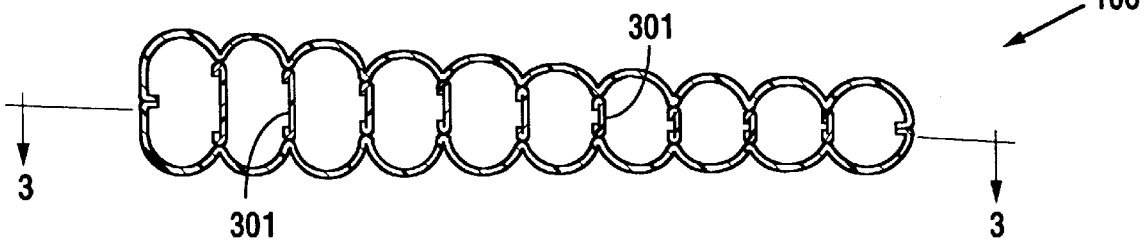
FIG. 4 shows a vertical cross sectional view of the top cushion of the head cushion assembly taken along the line 4—4 in FIG. 3.
Figure 5:
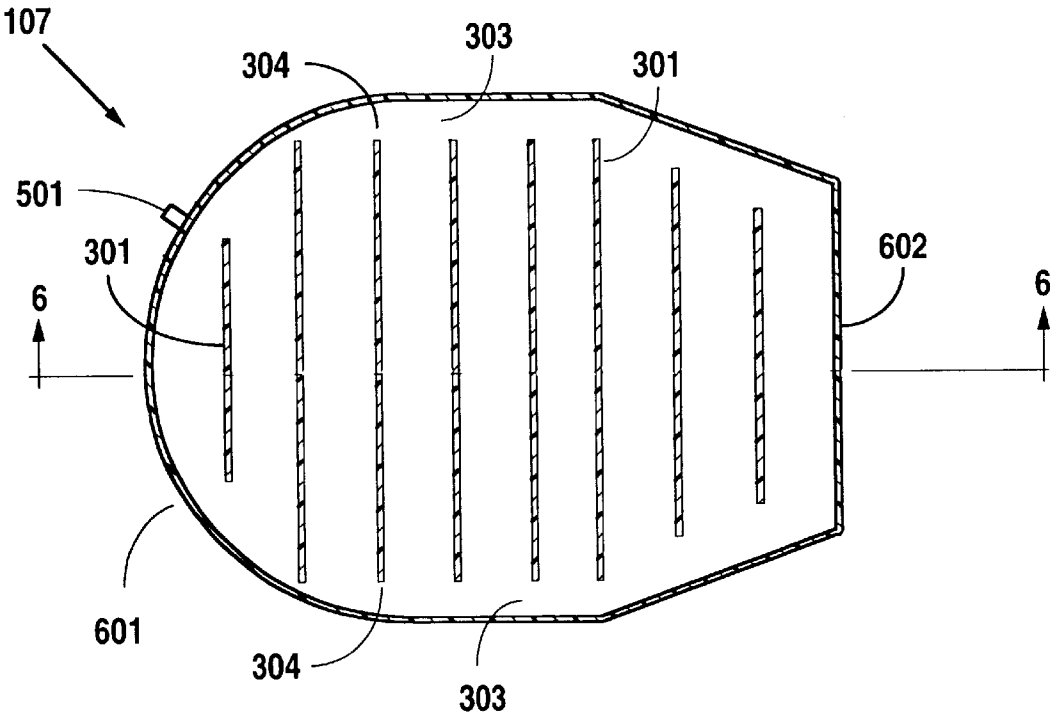
FIG. 5 shows a horizontal cross sectional view of the middle cushion of the head cushion assembly taken along line 5—5 in FIG. 6.
Figure 6:
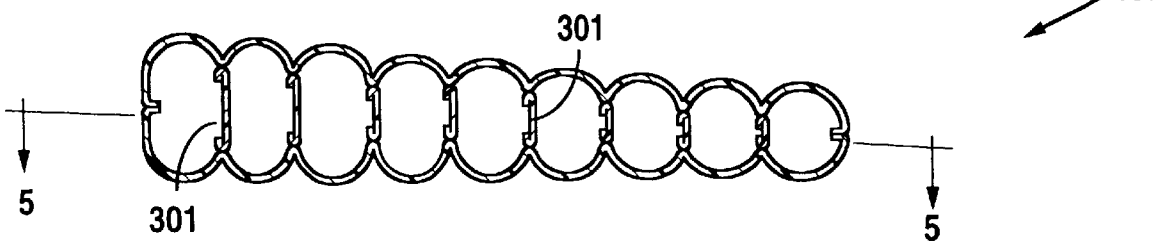
FIG. 6 shows a vertical cross sectional view of the middle cushion of the head cushion assembly taken along the line 6—6 in FIG. 5.
Figure 7:
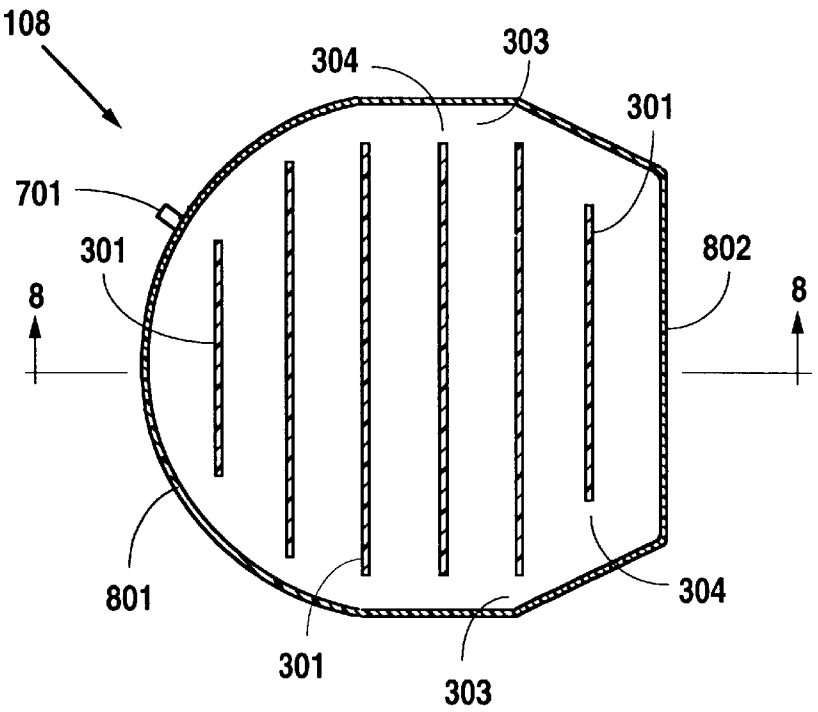
FIG. 7 shows a horizontal cross sectional view of the bottom cushion of the head cushion assembly taken along line 7—7 in FIG. 8.
Figure 8:
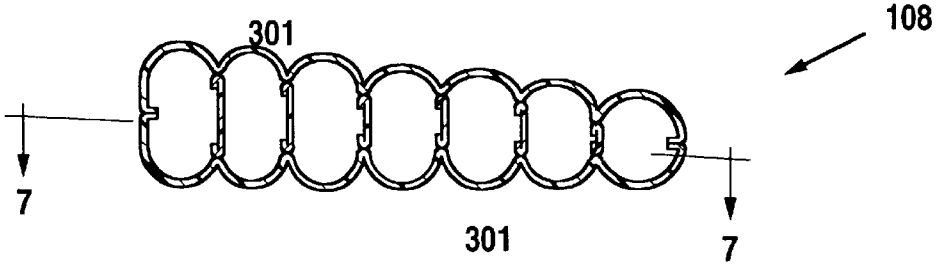
FIG. 8 shows a vertical cross sectional view of the bottom cushion of the head cushion assembly taken along the line 8—8 in FIG. 7.

As particularly depicted in FIGS. 3 through 8, each inflatable cushion 106, 107, 108 of the head cushion assembly 102 is preferably formed by affixing a plurality of baffles 301 interior to its respective chamber. Although not critical, it is preferred that the baffles 301 be equidistantly placed along the longitudinal axis of the patient support in order to facilitate a smoothly inclining patient surface. As shown in FIGS. 3, 5 and 7, the head end 401, 601, 801 of each inflatable cushion is preferably semi-circular in shape, following the contour of the head end of the support system's rigid tank. The torso end 402 of the top cushion is rectangular in shape while the torso ends 602, 802 of the middle cushion and bottom cushion are trapezoidal in shape. While not critical, these shapes are preferred for facilitating a downward bend in the torso end 402 of the top cushion 106 as the head cushion assembly 102 is inclined to its maximum level, thereby providing the patient maximum lumbar support while in the upright position. As shown in FIGS. 3, 5 and 7, each cushion 106, 107, 108 is formed with substantially triangular vertical cross-section for facilitating a smoothly inclining patient surface; those of ordinary skill in the art, however, will readily recognize many equivalent shapes.

Each cushion 106, 107, 108 is preferably constructed of low air loss material such as the substantially air and water impermeable, vapor permeable nylon mesh weave material commercially available from W.L. Gore & Associates under the well known trademark "GORE-TEX." Because this material will allow air to slowly leak through over time, it is only necessary to provide a source of pressurized fluid for each cushion; no exhaust is required. As shown in FIGS. 3, 5 and 7, each cushion is provided with a single quick-connect type hose fitting 302, 501, 701, such as is well known to those of ordinary skill in the art, in order to provide fluid communication from the inflation control assembly 1101, detailed further herein, to the respective cushions 106, 107, 108. Because each cushion is inflated via a single fitting 302, 501, 701, it is important that sufficient space 303 be allowed adjacent each baffle's ends 304 to enable uninhibited airflow throughout the length of each cushion 106, 107, 108.

Figure 9:
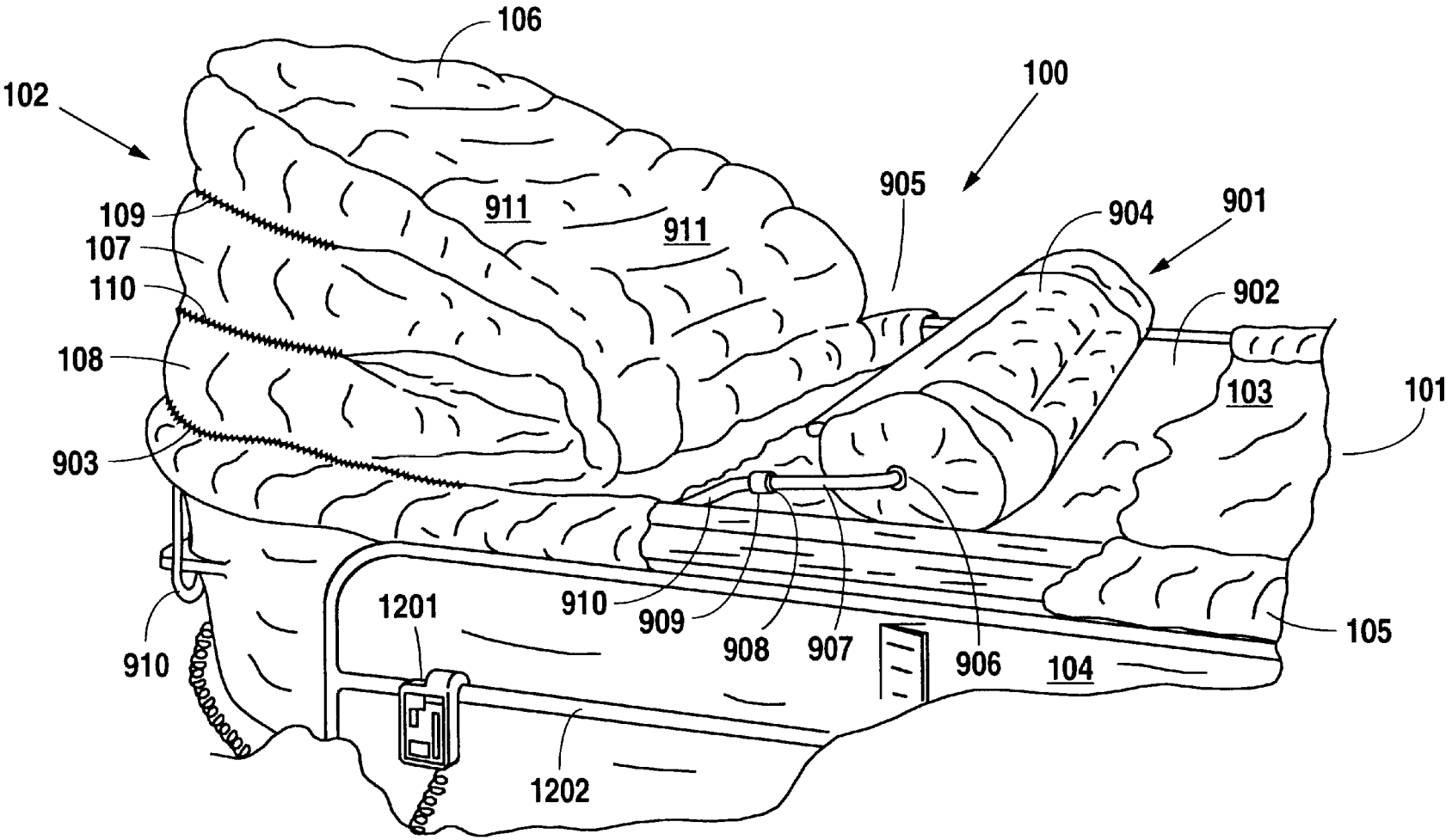
FIG. 9 shows partially cut away perspective view of the present invention detailing the knee gatch assembly.
Figure 10:
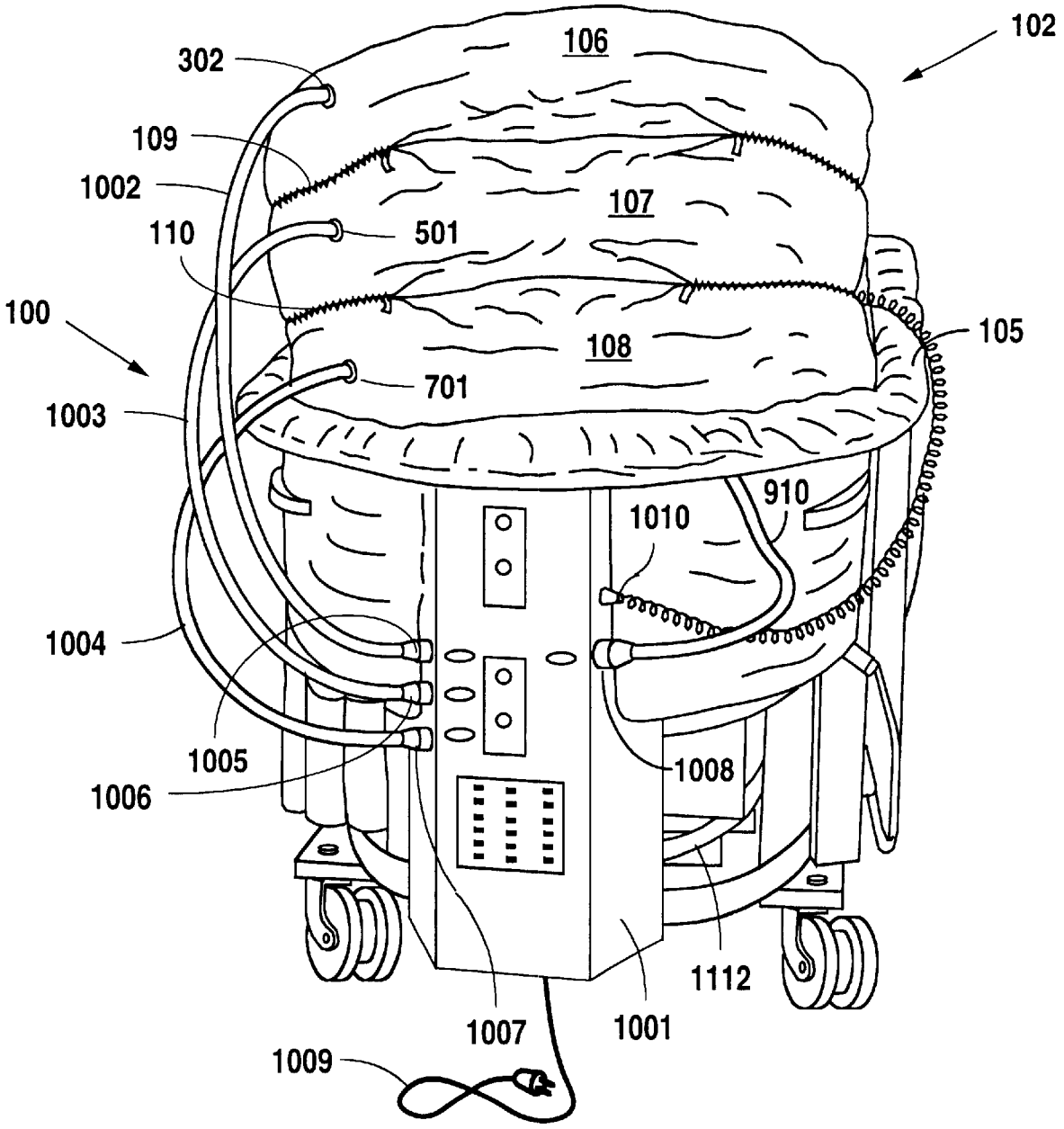
FIG. 10 shows an end elevation of the control assembly for the present invention.

As particularly depicted in FIGS. 1, 9 and 10, zipper mechanisms 109, 110, 903 are provided for removably attaching each inflatable cushion 106, 107, 108 to the adjacent cushion or cushions and/or the cover sheet 103 of the fluidized patient support system 101. Specifically, in the preferred embodiment, a zipper mechanism 109 is provided for removably attaching the lower, head end of the top cushion 106 to the upper, head end of the middle cushion 107; a zipper mechanism 110 is provided for removably attaching the lower, head end of the middle cushion 107 to the upper, head end of the bottom cushion 108; and a zipper mechanism 903 is provided for removably attaching the lower, head end of the bottom cushion 108 to the head end of the cover sheet 103. Although zipper mechanisms 109, 110, 903 are utilized in the preferred embodiment of the present invention, those of ordinary skill in the art will recognize many equivalent implementations such as, for example, releasably engageable hook and loop type fasteners, such as are commercially available under the well known trademark "VELCRO." Whatever the implementation, it will be appreciated by those of ordinary skill in the art that making the head cushion assembly 102 as well as its constituent cushions 106, 107, 108 removably attachable promotes cleaning of the cushions 106, 107, 108 and cover sheet 103 and facilitates any necessary maintenance of the cushions 106, 107, 108.

Referring now to FIG. 9, the present invention is depicted with the cover sheet partially cut away to reveal the knee gatch assembly 901 in the inflated state. In the preferred embodiment of the present invention, the knee gatch assembly 901 comprises an inflatable chamber 904, removably interposed between the cover sheet 103 and the uppermost air-permeable media-retaining sheet 902 of the fluidized patient support system 101. In order to allow adjustment of the knee gatch's longitudinal position, the assembly 901 is provided with a plurality of buckle tongues which may be mated with a larger plurality of buckle grooves disposed along the interior of the cover sheet 103 adjacent the sides of the support system's tank 104. In use, the buckle tongues are mated with appropriate buckle grooves to establish a trough 905 between the inflated head cushion assembly 102 and the inflated knee gatch assembly 901. This trough 905 should be sufficiently wide to comfortably retain therein the buttocks of the patient, but sufficiently narrow to disallow sliding of the patient during inclination of the head cushion assembly 102. Although buckles are preferred for the security they provide, those of ordinary skill in the art will recognize many alternative securing means such as, for example, releasably engageable hook and loop type fasteners, such as are commercially available under the well known trademark "VELCRO."

The inflatable cushion 904 of the knee gatch assembly 901 is preferably constructed of low air loss material such as the substantially air and water impermeable, vapor permeable nylon mesh weave material commercially available from W.L. Gore & Associates under the well known trademark "GORE-TEX." Because this material will allow air to slowly leak through over time, it is only necessary to provide a source of pressurized fluid for the cushion; no exhaust is required. As shown in FIG. 9, the cushion 904 is provided with a single hose fitting 906 in order to provide fluid communication from the inflation control assembly 1101, detailed further herein, to the cushion 904. As also shown in FIG. 9, a short air hose 907, terminating with a quick-connect fitting 908, such as is well known to those of ordinary skill in the art, is attached to the cushion's fitting 906. This hose 907 is attachable, through a mating quick-connect fitting 909, to an air supply hose 910, from the inflation control assembly 1101, disposed beneath the fluidized support system's cover sheet 103. The short air hose 907 is preferably of sufficient length to allow longitudinal repositioning of the knee gatch assembly 901 without necessity for positional adjustment of the supply hose 910.

Figure 11:
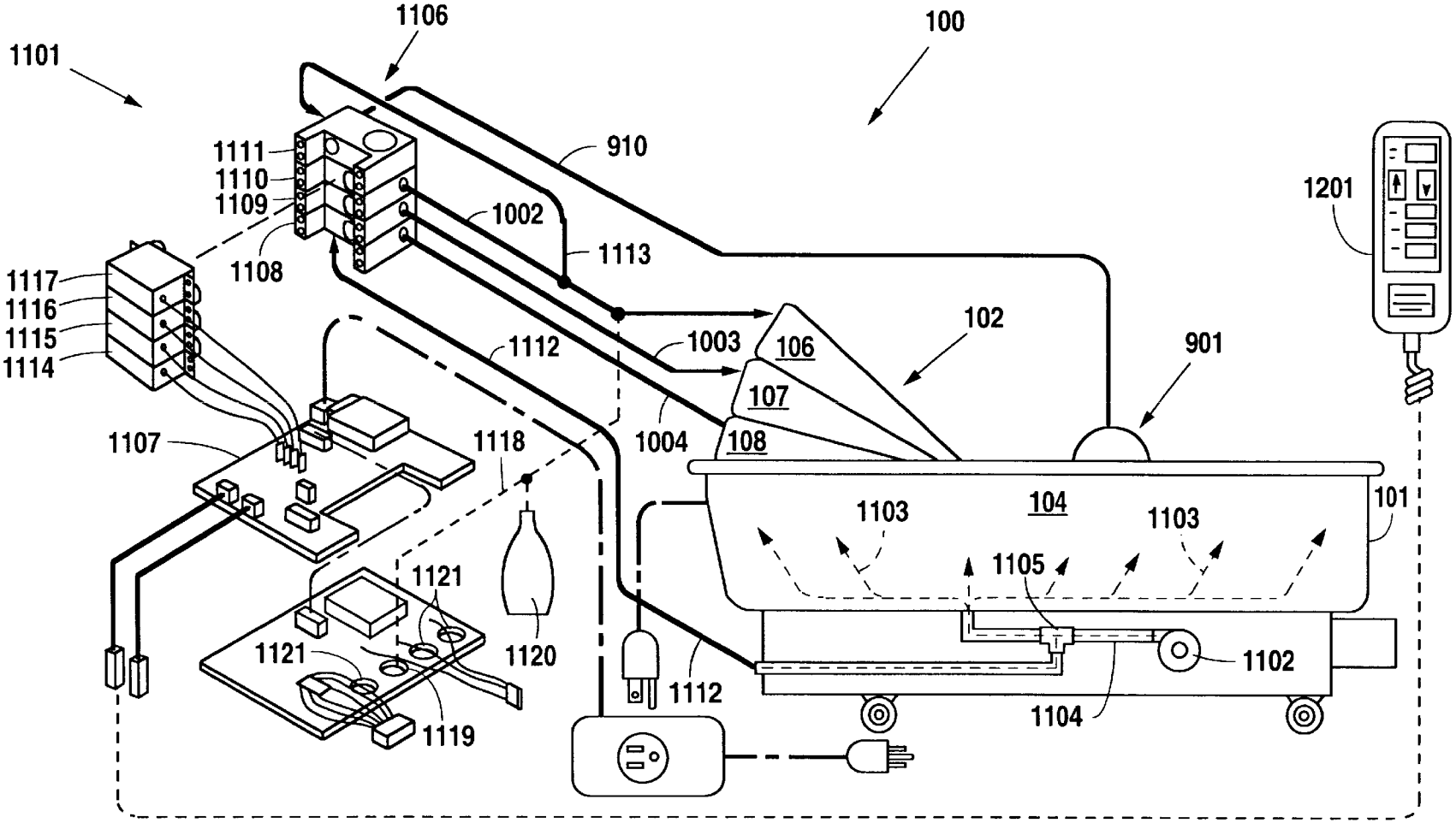
FIG. 11 shows a schematic block diagram of the control assembly for the present invention, including the interface of the invention to a fluidized patient support system.

Referring now to FIGS. 10 and 11, the control assembly 1101 for the present invention is described in detail. As particularly depicted in FIG. 10, the control assembly of the present invention is preferably contained within a housing exterior 1001 to the main body of the fluidized patient support system 101. Although not required, this implementation allows the same assembly structure to be utilized in original bed designs and after market modifications. It also allows the entire control assembly 1101 to be readily removed for factory repair if necessary. According to this preferred embodiment, a plurality of air hoses 910, 1002, 1003, 1004, each with quick-connect fittings, provide fluid communication between the control assembly 1101 and the various cushions 106, 107, 108, 904 of the invention. In particular, three preferably identical hoses 1002, 1003, 1004 provide communication between the quick-connect fitting 1005 of the top cushion air source and the quick-connect fitting 302 of the top cushion 106; between the quick-connect fitting 1006 of the middle cushion air source and the quick-connect fitting 501 of the middle cushion 107; and between the quick-connect fitting 1007 of the bottom cushion air source and the quick-connect fitting 701 of the bottom cushion 108. As has been partially described herein, a knee gatch cushion supply hose 910, which is routed under the cover sheet's flexible extrusion 105, connects to a quick-connect fitting 1008 to provide fluid communication from the control assembly 1101 to the knee gatch assembly's inflatable cushion 904. Additionally, a connection 1009 is provided to supply operating power to the system. Finally, a low voltage electrical socket 1010 is provided to interface the handheld control unit 1201, detailed further herein, to the control assembly 1101. In the preferred embodiment of the present invention, the socket 1010 for the handheld control 1201 comprises an RJ-11 jack, well known to those of ordinary skill in the art.

As shown schematically in FIG. 11, pressurized air for inflating the various cushions 106, 107, 108, 904 of the present invention is taken from the air distribution manifold 1104 of the fluidized patient support system 101. The manifold 1104, which is commonly provided in fluidized patient support systems for distributing fluidizing air 1103 to the fluidizable media, is retrofitted with a T-fitting 1105, diverting at least part of the airflow generated by the system's variable speed blower units 1102 to a valve block 1106 housed within the control assembly 1101. A microprocessor based control circuit 1107, also housed within the control assembly 1101, monitors and adjusts airflow through the individual valves 1108, 1109, 1110, 1111 of the valve block 1106 in response to patient and/or caregiver control inputs as well as patient movement. Under this control system, any desired inclination between supine and approximately 45° may be achieved and maintained and patient sliding may be prevented. Additionally, as will be better understood further herein, the pressure within the top cushion 106 and knee gatch cushion 904 may be adjusted under this control system to select the desired firmness for the patient support surface 911.

According to the preferred embodiment of the present invention, the valve block 1106 comprises four individually adjustable, pneumatic flow-control valves 1108, 1109, 1110, 1111. Although other implementations are possible, the preferred embodiment comprises stackable valves 1108, 1109, 1110, 1111 enabling the formation of common manifolds as desired. According to the present invention, such a common manifold is established for three valves 1108, 1109, 1110, one each corresponding to the bottom cushion 108, the middle cushion 107 and the top cushion 106, respectively.

This manifold is then placed in fluid communication with the support system's variable speed blower units 1102 via an interposed supply hose 1112. In this configuration, the inflation of each of the three head cushions 106, 107, 108 may be independently controlled depending upon the state of the corresponding valve 1110, 1109, 1108. As depicted in FIG. 11, the fourth valve 1111 is oriented so as to not form part of the common manifold; rather, the fourth valve 1111, the output of which supplies pressurized air to the knee gatch cushion 904, receives pressurized fluid from a shunt hose 1113 in fluid communication with the output of the third valve 1110. In this configuration, the knee gatch cushion 904 may only be inflated during inflation of the top cushion 106.

In implementing the present invention, each valve 1108, 1109, 1110, 1111 is operatively mated with a rugged, low profile servo 1114, 1115, 1116, 1117. In the preferred embodiment, a multiple gear, indirect drive, trackable position model FP-S148 servo, commercially available from the Futaba Corporation of Chiba, Japan is utilized. Under microprocessor 1107 control, the respective servos 1114, 1115, 1116, 1117 may be utilized to adjust each valve 1108, 1109, 1110, 1111 for virtually any flow rate from none to full. According to the preferred embodiment, the full range of control is implemented for the three valves 1108, 1109, 1110 corresponding to the head cushion assembly 102 while the fourth valve 1111, corresponding to the knee gatch assembly 901, is utilized as an on or off control valve.

As mentioned above, the pressure within the top cushion 106 and knee gatch cushion 904 may be adjusted under the implemented control system to select the desired firmness for the patient support surface 911. In order to effect this function, the pressure within the hoses 1002 feeding the top cushion 106 is monitored through a shunt hose 1118 to a solid state pressure transducer 1119. Pressure information is then utilized by the microprocessor 1107 in a set point tracking algorithm to adjust the third valve 1110 to increase or decrease pressure within the top cushion 106 as necessary to maintain the desired firmness. As will be apparent to those of ordinary skill in the art, the pressure within the knee gatch cushion 904 will be simultaneously adjusted, so long as the knee gatch function is selected. It should be noted that when implementing such a pressure feedback system, it is critical to obtain accurate and stable pressure measurements. To this end, an air reservoir 1120 is preferably provided along the pressure shunt hose 1118 to help calm the airflow therein.

Figure 12:
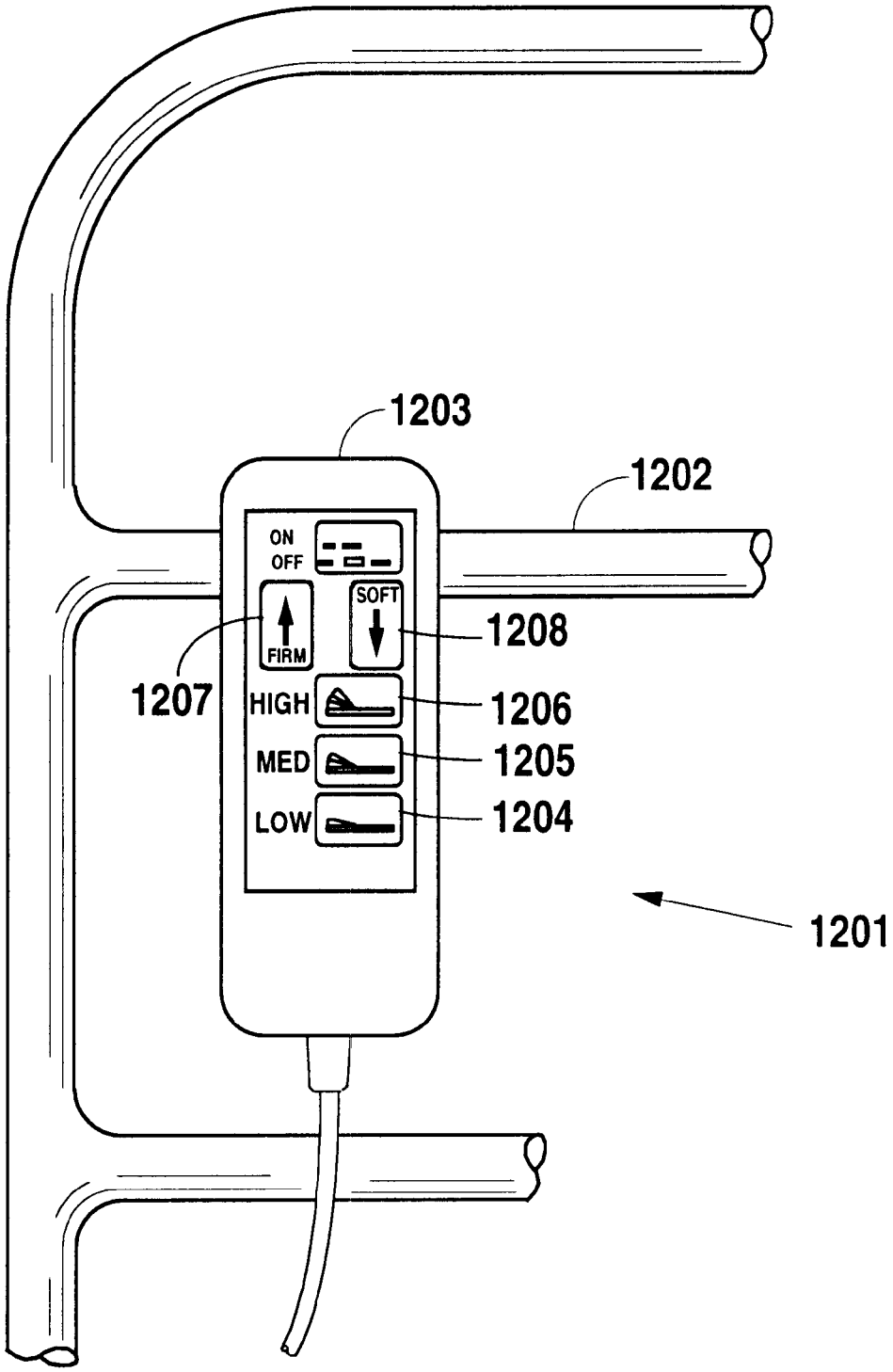
FIG. 12 shows a detail of the handheld control unit for use with the present invention.

Referring now particularly to FIG. 12, the handheld control unit 1201 for the present invention is detailed. As shown, the unit 1201 is adapted to hang from a bed rail 1202, facilitating access for the patient and caregiver alike. In the preferred embodiment, the handheld unit 1201 comprises switches for turning the system on and off, increasing support surface 911 firmness, decreasing support surface 911 firmness, and for activating the bottom, middle and top cushions 108, 107, 106. As will be apparent to those of ordinary skill in the art, many functional combinations may be readily implemented in a wide variety of layouts on such a handheld unit 1201.

According to the preferred method for operation of the present invention, the patient and/or caregiver may choose from a variety of inclination and firmness settings for the three inflatable cushions 106, 107, 108 of the head cushion assembly 102 and the inflatable cushion 904 of the knee gatch assembly 901. When the patient and/or caregiver desires to utilize the elevation apparatus, she presses the ON/OFF button 1203 on the handheld control 1201, causing a signal to be transmitted to the microprocessor based control circuit 1107. The control circuit 1107 then effects the appropriate opening of the third air control valve 1110 to supply inflating airflow to the top cushion 106, elevating the patient's head and torso to 15° with a pressure calculated to provide midrange firmness. Once activated the patient and/or caregiver may at any time depress the LOW button 1204 to achieve 15° inclination at the then selected firmness level, as will be understood further herein. Depression at any time of the MED button 1205 will cause the microprocessor circuit 1107 to activate the second and third air control valves 1109, 1110 to supply inflating airflow to the middle and top cushions 107, 106, elevating the patient's head and torso to 30° inclination, and depression at any time of the HIGH button 1206 will cause the microprocessor circuit 1107 to activate the first, second and third air control valves 1108, 1109, 1110 to supply inflating airflow to the bottom, middle and top cushions 108, 107, 106, elevating the patient's head and torson to 45° inclination.

In addition to the range of inclination adjustment enabled by the present invention, the desired firmness of the patient support surface 911 is also fully adjustable. The patient and/or caregiver need only depress the FIRM button 1207 on the handheld control unit 1201 to increase the firmness or depress the SOFT button 1208 on the handheld control unit 1201 to decrease the firmness. When either button 1207, 1208 is depressed, a set point for the desired pressure within the top cushion 106 is incremented or decremented, as appropriate, within the microprocessor control circuit 1107. This set point is then tracked against the cushion pressure as measured by the solid state pressure transducer 1119, whereby the microprocessor 1107 issues appropriate command signals to the third air control valve 1110 to increase or decrease the pressure as necessary to maintain the desired firmness.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and the claims drawn hereto. For example, those of ordinary skill in the art will recognize that additional solid state pressure transducers 1121 could be utilized in a more elaborate feedback mechanism whereby the patient surface 911 could be maintained in nearly any angle between supine and 45°. In any case, because the scope of the present invention is much broader than any particular embodiment, the foregoing detailed description should not be construed as a limitation of the present invention, which is limited only by the claims appended hereto.

What is claimed is:

1. An apparatus for elevating the head and torso of a patient using a fluidizable patient support system, comprising:

a fluidizable patient support system comprising a mass of fluidizable solid media retained beneath an air-permeable sheet, said patient support system having a head end and a leg end; and an inflatable upper body lift at said head end of said patient support system for elevating the head and torso of a patient using said patient support system.

2. The head and torso elevating apparatus as recited in claim 1, wherein said inflatable upper body lift comprises a plurality of inflatable chambers.

3. The head and torso elevating apparatus as recited in claim 2, wherein said inflatable chambers are stacked one atop another.

4. The head and torso elevating apparatus as recited in claim 2, wherein said inflatable chambers are removably attached one to another.

5. The head and torso elevating apparatus as recited in claim 2, wherein said inflatable chambers comprise a low air loss material.

6. The head and torso elevating apparatus as recited in claim 1, wherein said inflatable upper body lift is removably attached to said fluidizable patient support system.

7. The head and torso elevating apparatus as recited in claim 1, further comprising a lower body lift between said upper body lift and said leg end of said fluidizable patient support system, said lower body lift being adapted to prevent sliding of the patient during elevation of the patient's head and torso.

8. The head and torso elevating apparatus as recited in claim 1, wherein said lower body lift comprises an inflatable chamber, said lower body lift inflatable chamber being removably attached to said fluidizable patient support system.

9. The head and torso elevating apparatus as recited in claim 7, wherein said lower body lift inflatable chamber and at least one said upper body lift inflatable chamber are in fluid communication with a common source of pressurized fluid.

10. The head and torso elevating apparatus as recited in claim 9, wherein said common source of pressurized fluid may be automatically regulated to maintain a selected patient support surface firmness.

* * * * *